US010023450B2

(12) United States Patent
Jeffries

(10) Patent No.: US 10,023,450 B2
(45) Date of Patent: Jul. 17, 2018

(54) BOOM TRUCK BUCKET REMOTE CONTROL ASSEMBLY

(71) Applicant: Joseph Jeffries, Rockford, IL (US)

(72) Inventor: Joseph Jeffries, Rockford, IL (US)

( * ) Notice: Subject to any disclaimer, the term of this patent is extended or adjusted under 35 U.S.C. 154(b) by 51 days.

(21) Appl. No.: 15/243,325

(22) Filed: Aug. 22, 2016

(65) Prior Publication Data

US 2018/0050893 A1 Feb. 22, 2018

(51) Int. Cl.
*B66F 13/00* (2006.01)
*B66F 11/04* (2006.01)

(52) U.S. Cl.
CPC ..... *B66F 11/044* (2013.01)

(58) Field of Classification Search
CPC ..... B66F 11/044
See application file for complete search history.

(56) References Cited

U.S. PATENT DOCUMENTS 2,700,481 A 1/1955 Donatelli
3,149,694 A 9/1964 Smithee
3,489,243 A 1/1970 Prescott et al.
3,516,514 A 6/1970 Malloy et al.
4,160,492 A * 7/1979 Johnston ..... B66F 11/046 182/148
4,722,044 A * 1/1988 Heiser ..... E02F 9/2037 414/700
4,724,924 A * 2/1988 Breyer ..... B66F 11/044 182/2.8
5,058,752 A * 10/1991 Wacht ..... B66C 23/90 212/231
5,107,954 A * 4/1992 Fujimoto ..... B66F 11/046 182/2.11
5,486,084 A * 1/1996 Pitman ..... B60P 1/5433 188/171
5,934,409 A * 8/1999 Citron ..... B66F 11/044 182/17
6,405,114 B1 * 6/2002 Priestley ..... B66F 11/046 182/18
D475,026 S 5/2003 Buczek et al.
9,079,758 B2 7/2015 O'Dougherty
2015/0292178 A1 * 10/2015 Nagato ..... E02F 9/2285 701/50
2015/0292185 A1 * 10/2015 Nagato ..... E02F 3/435 701/33.9
2017/0305018 A1 * 10/2017 MacHida ..... B25J 19/023

* cited by examiner

*Primary Examiner* — Mussa A Shaawat

(57) ABSTRACT

A boom truck bucket remote control assembly for emergency use to remotely control a bucket includes a first housing. The first housing is configured to couple proximate to a first manipulator that is operationally coupled to a truck bucket. A plurality of actuators, coupled to and positioned in the first housing, is configured to couple to the first manipulator. A first microprocessor and a receiver are coupled to and positioned in the first housing. The receiver is operationally coupled to the first microprocessor. The receiver is configured to receive wireless signals. A controller is configured to wirelessly signal the first microprocessor to motivate a respective actuator to override a second manipulator that is positioned in the bucket. The first microprocessor is positioned to motivate the plurality of actuators to compel the first manipulator to reposition the bucket independently of an occupant of the bucket.

8 Claims, 4 Drawing Sheets

BOOM TRUCK BUCKET REMOTE CONTROL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to bucket control assemblies and more particularly pertains to a new bucket control assembly for emergency use to remotely control a bucket.

BRIEF SUMMARY OF THE INVENTION

An embodiment of the disclosure meets the needs presented above by generally comprising a first housing. The first housing is configured to couple proximate to a first manipulator that is operationally coupled to a truck bucket. A plurality of actuators, coupled to and positioned in the first housing, is configured to couple to the first manipulator. A first microprocessor and a receiver are coupled to and positioned in the first housing. The receiver is operationally coupled to the first microprocessor. The receiver is configured to receive wireless signals. A controller is configured to wirelessly signal the first microprocessor to motivate a respective actuator to override a second manipulator that is positioned in the bucket. The first microprocessor is positioned to motivate the plurality of actuators to compel the first manipulator to reposition the bucket independently of an occupant of the bucket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
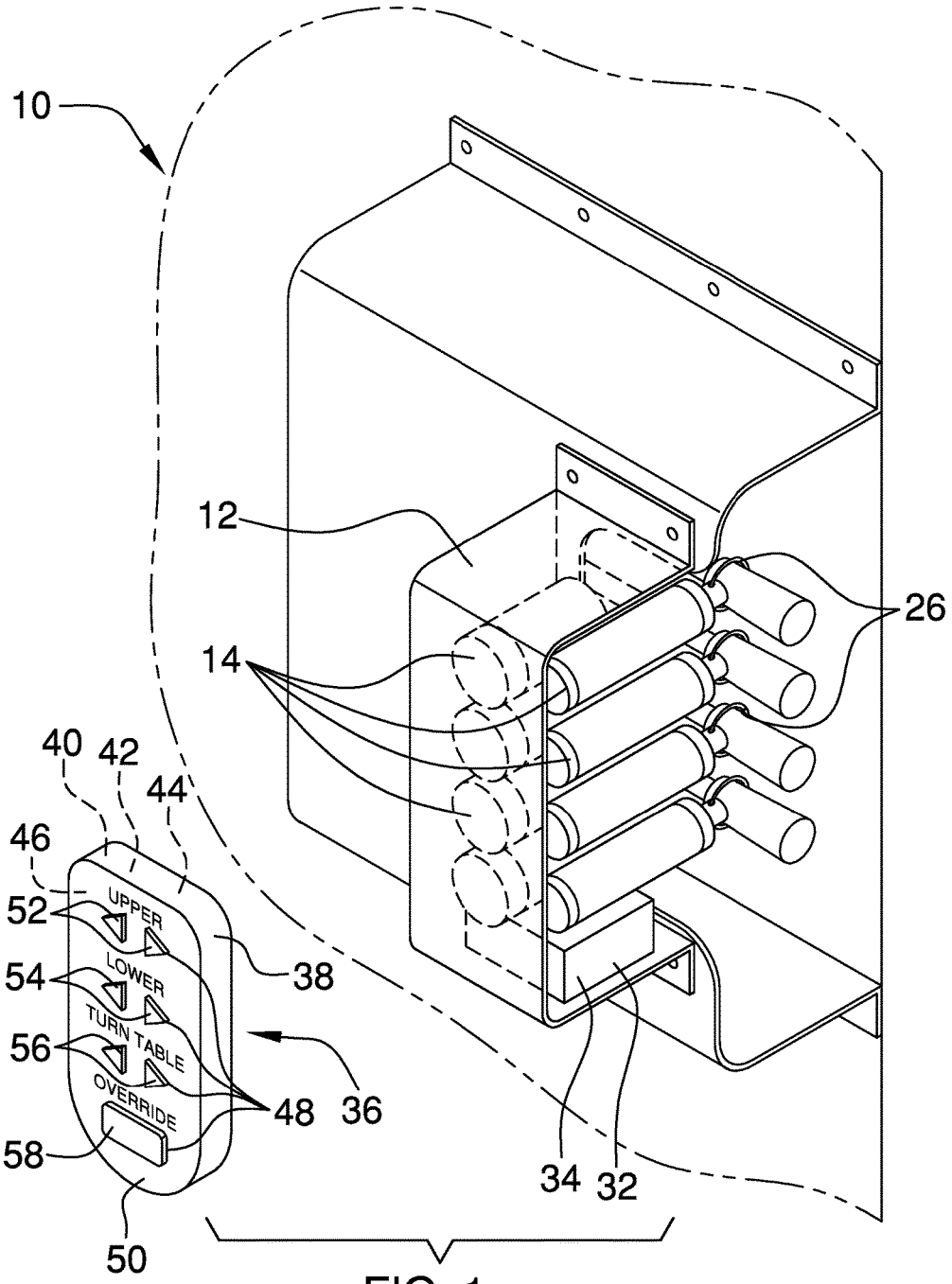
FIG. 1 is an isometric perspective view of a boom truck bucket remote control assembly according to an embodiment of the disclosure.
Figure 2:
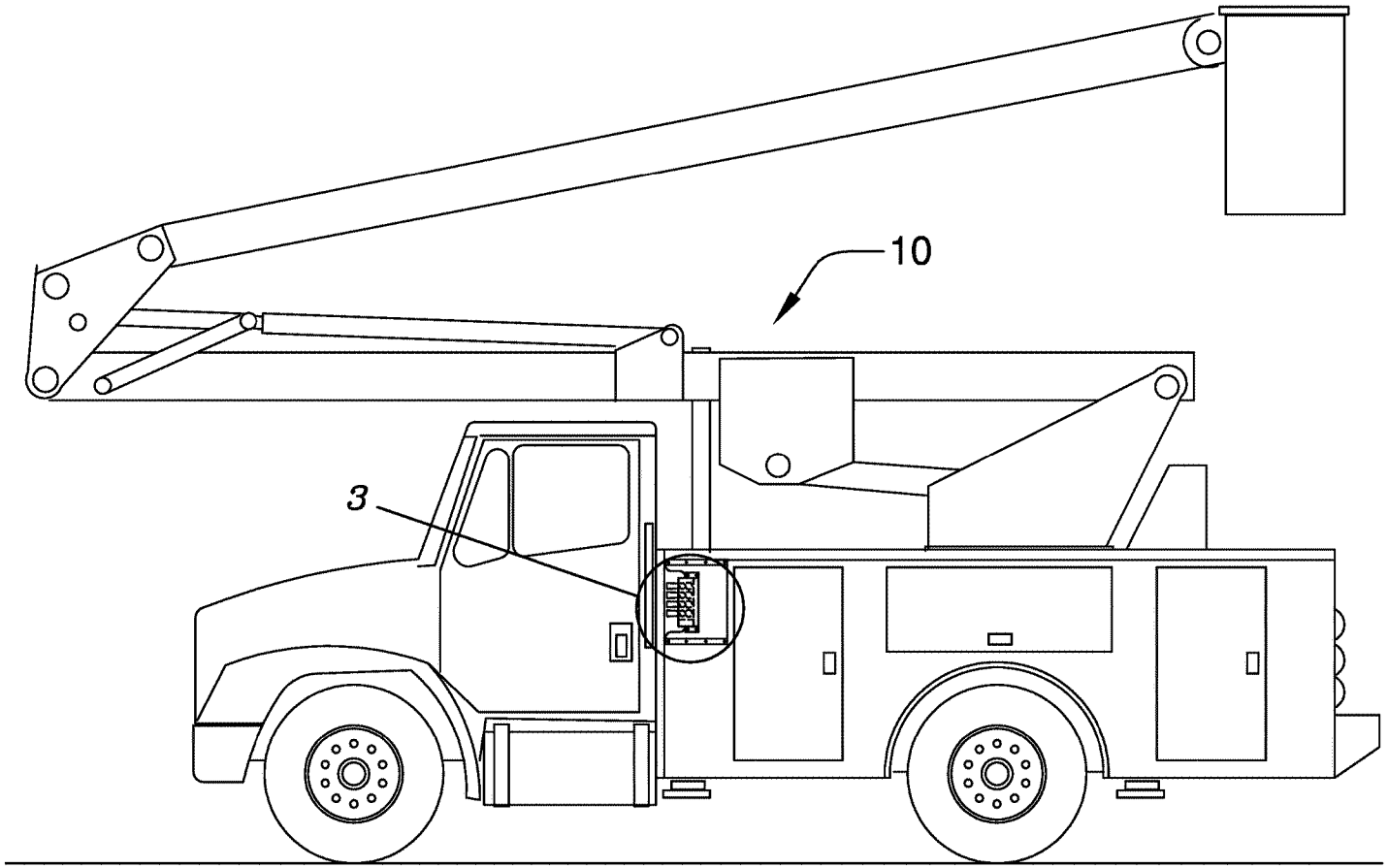
FIG. 2 is an in-use view of an embodiment of the disclosure.
Figure 3:
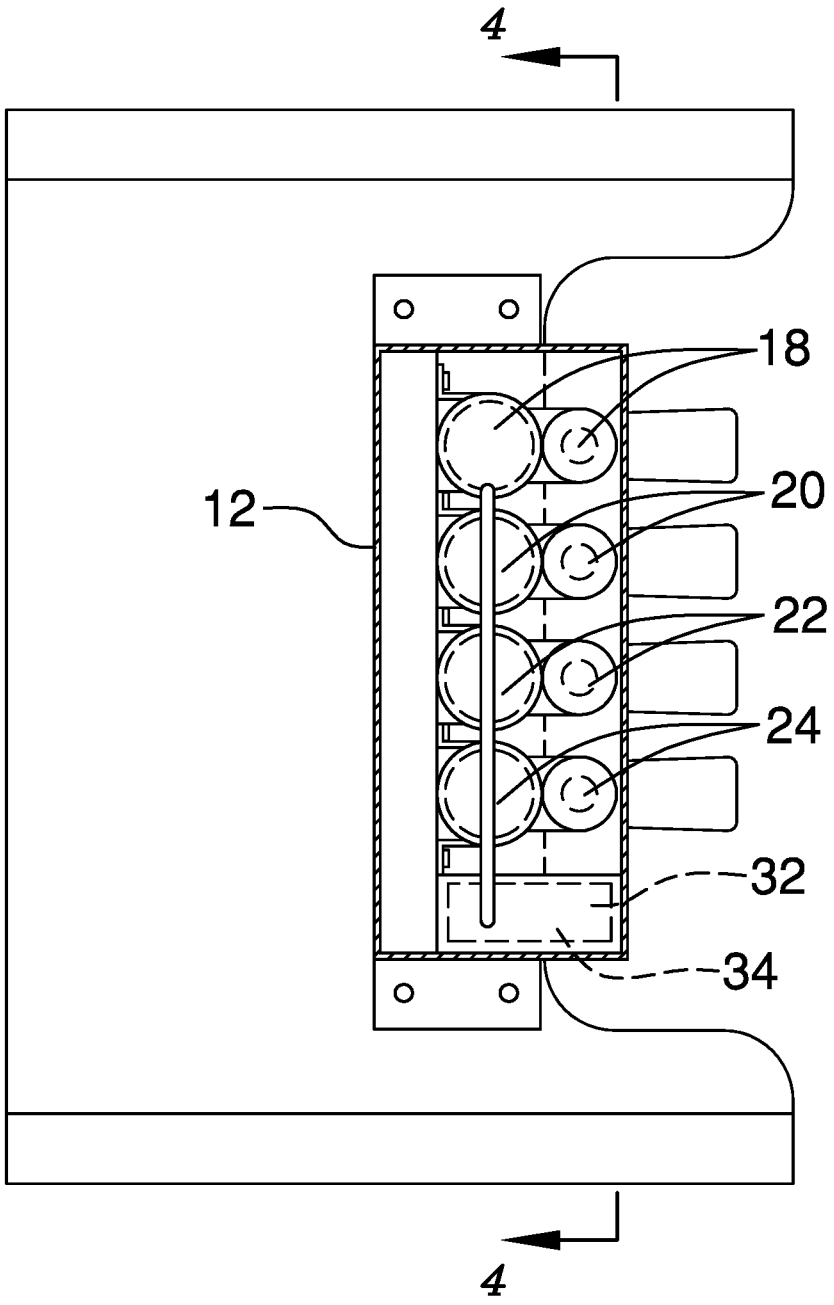
FIG. 3 is a cross-sectional view of an embodiment of the disclosure.
Figure 4:
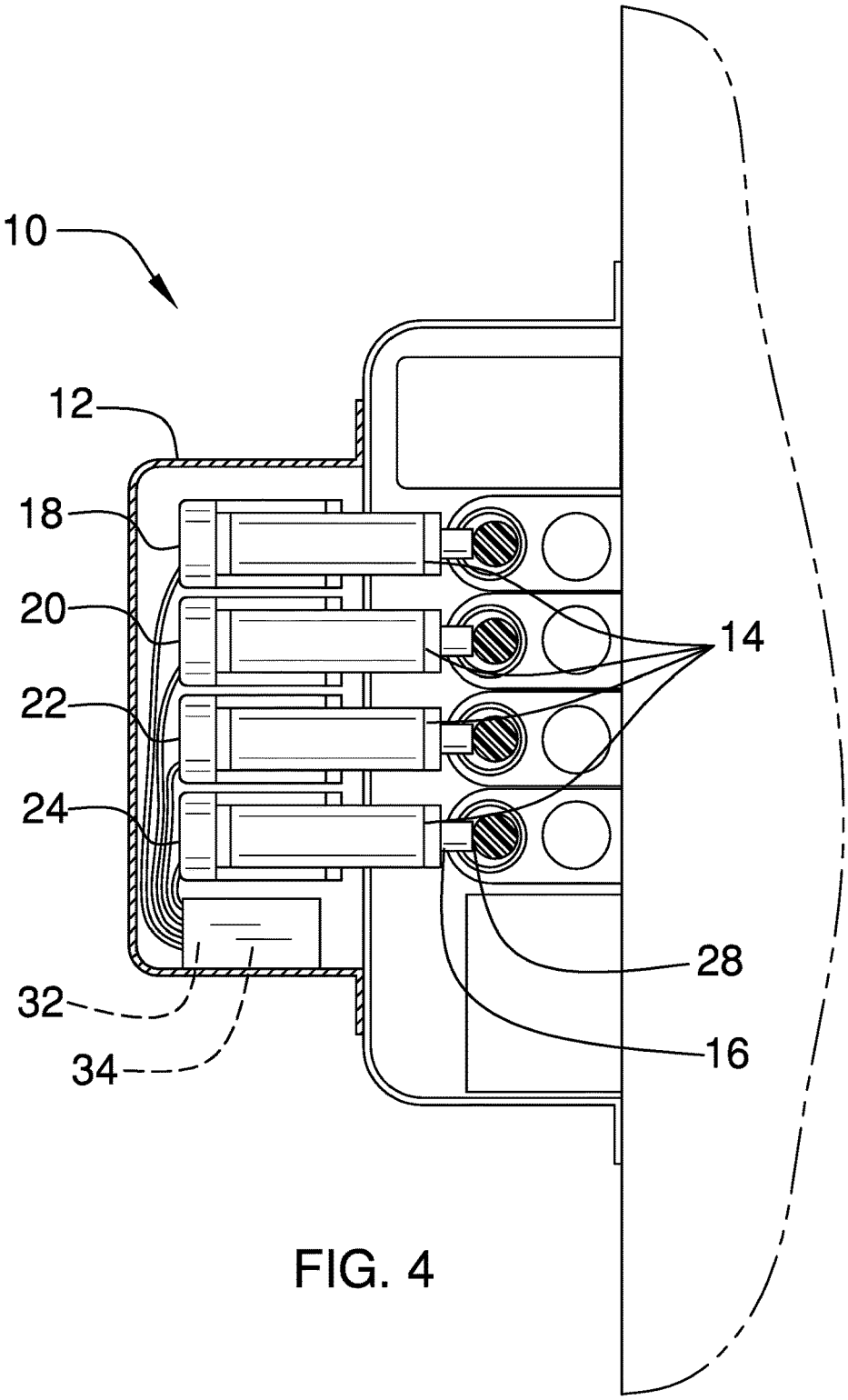
FIG. 4 is a front view of an embodiment of the disclosure.

With reference now to the drawings, and in particular to FIGS. 1 through 4 thereof, a new bucket control assembly embodying the principles and concepts of an embodiment of the disclosure and generally designated by the reference numeral 10 will be described.

As best illustrated in FIGS. 1 through 4, the boom truck bucket remote control assembly 10 generally comprises a first housing 12. The first housing 12 is configured to couple proximate to a first manipulator that is operationally coupled to a truck bucket.

A plurality of actuators 14 is coupled to and positioned in the first housing 12. Each actuator 14 is configured to couple to the first manipulator. The actuators 14 are electro-mechanical, such that pistons 16 of the actuators 14 are able to both push and pull. In one embodiment, the plurality of actuators 14 comprises an upper arm biaser 18, a lower arm biaser 20, a turntable biaser 22 and an override biaser 24. The upper arm biaser 18 configured to manipulate an upper segment of the bucket assembly. The lower arm biaser 20 configured to manipulate a lower segment of the bucket assembly. The turntable biaser 22 configured to manipulate a rotator of the bucket assembly. The override biaser 24 is configured to supersede a second manipulator of the bucket assembly.

Each of a plurality of couplers 26 is coupled to an end 28 of a respective piston 16. Each coupler 26 is configured to couple to a respective knob of the first manipulator. In one embodiment, each coupler 26 comprises a ring 30 that is positioned through and extends from the end 28 of the respective piston 16. The ring 30 is positioned on the end 28 such that the ring 30 is configured to insert the respective knob of the first manipulator.

A first microprocessor 32 and a receiver 34 are coupled to and positioned in the first housing 12. In one embodiment, the first microprocessor 32 is operationally coupled to a power supply of the truck. The receiver 34 is operationally coupled to the first microprocessor 32. The receiver 34 is configured to receive wireless signals.

The assembly 10 comprises a controller 36 that is configured to send wireless signals. The controller 36 comprises a second housing 38. In one embodiment, the second housing 38 is substantially rectangularly box shaped. A power module 40, a second microprocessor 42 and a transmitter 44 are coupled to and positioned in the second housing 38. In one embodiment, the power module 40 comprises at least one battery 46. The second microprocessor 42 is operationally coupled to the power module 40. The transmitter 44 is operationally coupled to the second microprocessor 42.

A control panel 48 is coupled to the second housing 38. The control panel 48 is operationally coupled to the second microprocessor 42. The control panel 48 is positioned to compel the second microprocessor 42 to signal the first microprocessor 32. In one embodiment, the control panel 48 is positioned on a front face 50 of the second housing 38. In another embodiment, the control panel 48 comprises an upper arm switch 52, a lower arm switch 54, a turntable switch 56 and an override button 58. The upper arm switch 52 is configured to input commands to motivate the upper arm biaser 18 to manipulate the upper segment of the bucket assembly. The lower arm switch 54 is configured to input commands to motivate the lower arm biaser 20 to manipulate the lower segment of the bucket assembly. The turntable switch 56 is configured to input commands to motivate the turntable biaser 22 to manipulate the rotator of the bucket assembly. The override button 58 is configured to input a command to motivate the override biaser 24 to supersede the second manipulator of the bucket assembly.

In use, the transmitter 44 of the controller 36 is positioned to wirelessly signal input from the control panel 48 to the receiver 34. The first microprocessor 32 is positioned to selectively motivate the upper arm biaser 18 to manipulate the upper segment of the bucket assembly, the lower arm biaser 20 to manipulate the lower segment of the bucket assembly, the turntable biaser 22 to manipulate the rotator of the bucket assembly, and the override biaser 24 to supersede the second manipulator of the bucket assembly. A user of the controller 36 is able to reposition the bucket independently of an occupant of the bucket, such as would be required in an emergency situation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A boom truck bucket remote control assembly comprising:

a first housing, said first housing being configured for coupling proximate to a first manipulator operationally coupled to a truck bucket;

a plurality of actuators coupled to and positioned in said first housing, each said actuator being configured to couple to the first manipulator, said actuators being electro-mechanicals, such that pistons of said actuators are enabled for pushing and pulling movements, said plurality of actuators comprising an upper arm biaser configured to manipulate an upper segment of the bucket assembly;

a lower arm biaser configured to manipulate a lower segment of the bucket assembly;

a turntable biaser configured to manipulate a rotator of the bucket assembly; and an override biaser configured to supersede the second manipulator of the bucket assembly;

a first microprocessor coupled to and positioned in said first housing;

a receiver coupled to and positioned in said first housing, said receiver being operationally coupled to said first microprocessor, said receiver being configured for receiving wireless signals;

a controller configured for sending wireless signals, said controller comprising:

a second housing, a power module coupled to and positioned in said second housing, a second microprocessor coupled to and positioned in said second housing, said second microprocessor being operationally coupled to said power module, a transmitter coupled to and positioned in said second housing, said transmitter being operationally coupled to second microprocessor, and a control panel coupled to said second housing, said control panel being operationally coupled to said second microprocessor, wherein said control panel is positioned to compel said second microprocessor to signal said first microprocessor, said control panel comprising an upper arm switch configured for input of commands to motivate said upper arm biaser to manipulate the upper segment of the bucket assembly, a lower arm switch configured for input of commands to motivate said lower arm biaser to manipulate the lower segment of the bucket assembly, a turntable switch configured for input of commands to motivate said turntable biaser manipulate the rotator of the bucket assembly, and an override button configured for input of a command to motivate said override biaser to supersede the second manipulator of the bucket assembly;

wherein said controller is positioned to wirelessly signal said first microprocessor to motivate a respective actuator to override a second manipulator positioned in the bucket, such that said controller is positioned to signal said first microprocessor to motivate said plurality of actuators to compel the first manipulator to reposition the bucket independent of an occupant of the bucket.

2. The assembly of claim 1, further including a plurality of couplers, each said coupler being coupled to an end of a respective said piston, each said coupler being configured for coupling to a respective knob of the first manipulator.

3. The assembly of claim 2, further including each said coupler comprising a ring positioned through and extending from said end of said respective said piston, wherein said ring is positioned on said end such that said ring is configured for insertion of the respective knob of the first manipulator.

4. The assembly of claim 1, further including said first microprocessor being operationally coupled to a power supply of the truck.

5. The assembly of claim 1, further including said control panel being positioned on a front face of said second housing.

6. The assembly of claim 1, further including said second housing being substantially rectangularly box shaped.

7. The assembly of claim 1, further including said power module comprising at least one battery.

8. A boom truck bucket remote control assembly comprising:

a first housing, said first housing being configured for coupling proximate to a first manipulator operationally coupled to a truck bucket;

a plurality of actuators coupled to and positioned in said first housing, each said actuator being configured to couple to the first manipulator, said actuators being electro-mechanicals, such that pistons of said actuators are enabled for pushing and pulling movements, said plurality of actuators comprising:

an upper arm biaser configured to manipulate an upper segment of the bucket assembly, a lower arm biaser configured to manipulate a lower segment of the bucket assembly, a turntable biaser configured to manipulate a rotator of the bucket assembly, and an override biaser configured to supersede the second manipulator of the bucket assembly;

a plurality of couplers, each said coupler being coupled to an end of a respective said piston, each said coupler being configured for coupling to a respective knob of the first manipulator, each said coupler comprising a ring positioned through and extending from said end of said respective said piston, wherein said ring is positioned on said end such that said ring is configured for insertion of the respective knob of the first manipulator;

a first microprocessor coupled to and positioned in said first housing, said first microprocessor being operationally coupled to a power supply of the truck;

a receiver coupled to and positioned in said first housing, said receiver being operationally coupled to said first microprocessor, said receiver being configured for receiving wireless signals;

a controller configured for sending wireless signals, said controller comprising:

a second housing, said second housing being substantially rectangularly box shaped, a power module coupled to and positioned in said second housing, said power module comprising at least one battery, a second microprocessor coupled to and positioned in said second housing, said second microprocessor being operationally coupled to said power module, a transmitter coupled to and positioned in said second housing, said transmitter being operationally coupled to second microprocessor, and a control panel coupled to said second housing, said control panel being operationally coupled to said second microprocessor, wherein said control panel is positioned to compel said second microprocessor to signal said first microprocessor, said control panel being positioned on a front face of said second housing, said control panel comprising:

an upper arm switch configured for input of commands to motivate said upper arm biaser to manipulate the upper segment of the bucket assembly, a lower arm switch configured for input of commands to motivate said lower arm biaser to manipulate the lower segment of the bucket assembly, a turntable switch configured for input of commands to motivate said turntable biaser to manipulate the rotator of the bucket assembly, and an override button configured for input of a command to motivate said override biaser to supersede the second manipulator of the bucket assembly;

wherein said transmitter of said controller is positioned to wirelessly signal input from said control panel to said receiver, such that said first microprocessor is positioned to selectively motivate said upper arm biaser to manipulate the upper segment of the bucket assembly, said lower arm biaser to manipulate the lower segment of the bucket assembly, said turntable biaser to manipulate the rotator of the bucket assembly, and said override biaser to supersede the second manipulator of the bucket assembly, such that a user of said controller is enabled to reposition the bucket independently of an occupant of the bucket.

* * * * *